United States Patent [19]

Shabrang et al.

[11] Patent Number: 4,720,330

[45] Date of Patent: Jan. 19, 1988

[54] DEVICE AND METHOD FOR ELECTROPLATING A WORKPIECE HAVING AXIAL SYMMETRY

[75] Inventors: Mani Shabrang, Midland; Daniel A. Gokey, Bay City, both of Mich.

[73] Assignee: The Dow Chemical Company, Midland, Mich.

[21] Appl. No.: 70,268

[22] Filed: Jul. 6, 1987

[51] Int. Cl.[4] ..... C25D 7/04; C25D 17/00; C25D 17/12; C25D 21/02

[52] U.S. Cl. ..... 204/25; 204/212; 204/238; 204/240; 204/241; 204/224 R; 204/DIG. 7

[58] Field of Search ..... 204/25, 212, 240, 241, 204/238, 224 R

[56] References Cited

U.S. PATENT DOCUMENTS

| | | | |
|---|---|---|---|
| 2,086,841 | 7/1937 | Bagley et al. | 204/212 X |
| 2,363,973 | 11/1944 | Kennedy et al. | 204/25 |
| 3,583,897 | 6/1971 | Fulweiler | 204/212 |
| 3,664,944 | 5/1972 | Buckley | 204/212 |
| 3,915,832 | 10/1975 | Rackus et al. | 204/212 |
| 4,659,447 | 4/1987 | Anzola et al. | 204/212 |

*Primary Examiner*—Donald R. Valentine
*Attorney, Agent, or Firm*—V. Dean Clausen

[57] ABSTRACT

The invention is a device and method for electroplating a metal workpiece having axial symmetry, such as a circular workpiece. In this invention the workpiece, which is the cathode, is rotated inside an anode structure submerged in the plating solution. Part of the rotating cathode continuously moves through a region of intense current fluxes created by passing DC current between the anode and cathode. The rotating cathode stirs the plating solution, which speeds up the plating rate. At the same time, with only part of the cathode passing continuously through the intense current flux region, the deposition process is periodically slowed down and intensified.

7 Claims, 4 Drawing Figures

DEVICE AND METHOD FOR ELECTROPLATING A WORKPIECE HAVING AXIAL SYMMETRY

BACKGROUND OF THE INVENTION

The invention relates to a device and method for electroplating metal workpieces. In particular, it relates to workpieces having axial symmetry, such as a circular workpiece.

In the practice of electroplating metal surfaces it is well-known that application of a modulating current has two major advantages: it improves the properties of the deposit, and it allows faster plating rates. Most common plating techniques that make use of a modulating current are those referred to as periodically reversed current, pulsed current, and asymmetric alternating current, which combines alternating current (AC) superimposed on direct current (DC). Studies of these techniques are described in the electroplating literature. For example, the use of sinusoidal AC current superimposed on DC current is described by C. C. Wan, H. Y. Cheh, and H. B. Linford in "The Application of Pulse Plating Techniques to Metal Deposition", Plating 61 (1974) 559, and by R. B. Snyder and H. Y. Cheh, Plating Surface Finish, 62 (1975) 786. Use of periodically reversed current is described by H. R. Despic and K. R. Popov in "Transport-Controlled Deposition and Dissolution of Metals", Modern Aspects Electrochemistry, 7 (1972) 199. Studies on pulse current are described by G. Perger and P. M. Robinson in Metal Finishing, 77 (12) (1979) 17.

In the electroplating techniques described above, it is critical to be able to periodically reverse the deposition process. The reversing step virtually halts dendritic growth of previously formed nuclei in the metal layer being deposited on the cathode surface, so that it has a beneficial effect in achieving a metal coating that is uniform and coherent. The technique that combines application of AC current superimposed on DC current is particularly suitable for obtaining high quality metal deposits. But this technique has certain disadvantages. For example, it requires a means for continuously stirring the plating solution and a signal generator for providing the alternating current to be superimposed on the DC current.

The present invention overcomes the problems described above. In this invention the cathode (the workpiece being plated) is rotated inside an anode structure submerged in the plating solution. As the cathode rotates, part of it continuously moves through a region of intense current fluxes created by passing DC current between the anode and cathode. The rotating cathode stirs the plating solution, which speeds up the plating rate. At the same time, with only part of the cathode continuously passing through the intense current flux region, the deposition process is periodically slowed down and intensified.

SUMMARY OF THE INVENTION

The invention is a device and method for electroplating a metal workpiece, particularly a piece having axial symmetry. The device includes a plating tank that contains a given amount of an electrolyte solution that includes metal ions. Another component is an anode structure made up of three anode plates. The first and second plates are spaced apart and in parallel relation and the third plate is spaced from and perpendicular to the first and second plates.

The space bounded by the three plates defines an anode chamber in which the first and second plates are each partial wall members of the chamber and the third plate is a full wall member. Another component is a cathode structure that includes a metal rod, a workpiece holder that is fastened near one end of the rod by a metal pin, and a workpiece with axial symmetry that has an inside surface. When the workpiece is fitted onto the holder one end of the metal pin is in contact with the inside surface of the workpiece. The anode structure is positioned inside the plating tank and completely submerged in the electrolyte solution.

The metal rod of the cathode is positioned in the plating tank, so that the workpiece is submerged in the electrolyte solution. The workpiece itself is located inside the anode chamber, so that about half of its outside surface lies between the first and second anode plates and the remainder of this surface lies in a part of the chamber that is not between the first and second anode plates. Other components include a rotator means associated with the metal rod and an electrical power unit. The power unit supplies only DC current to the anode and cathode structures and it includes a cathode connector in contact with the metal rod and an anode connector in contact with the anode structure.

In the operation of this device, the rotator means rotates the metal rod to cause the workpiece to revolve inside the anode structure. The electrical power unit directs DC current through the cathode connector into the metal rod and then into the workpiece, and it also directs DC current through the anode connection into the anode structure. The flow of current between the anode and cathode causes the metal ions in the electrolyte solution to plate out on the wokpiece.

DESCRIPTION OF THE INVENTION

Figure 1:
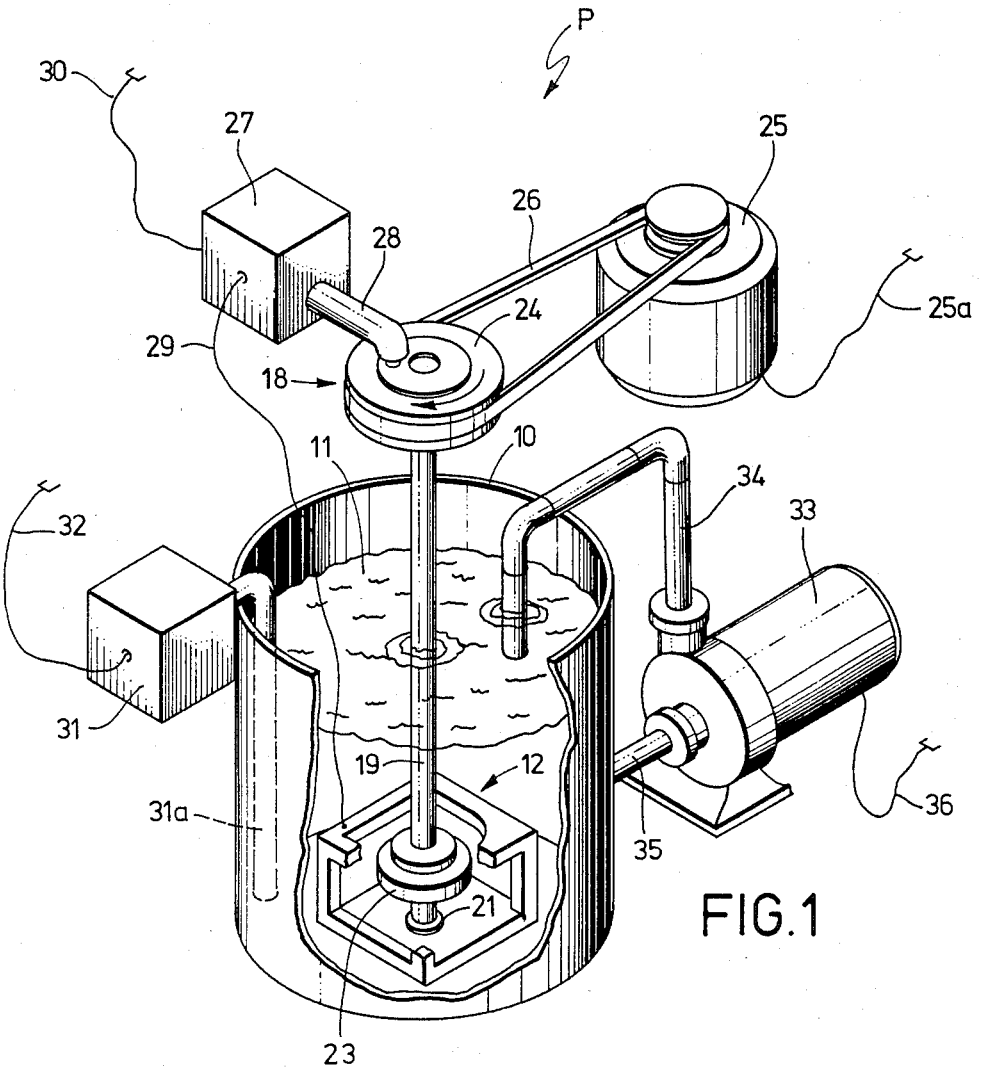
FIG. 1 is an isometric view, mostly in schematic illustration, of the electroplating device of this invention.
Figure 2:
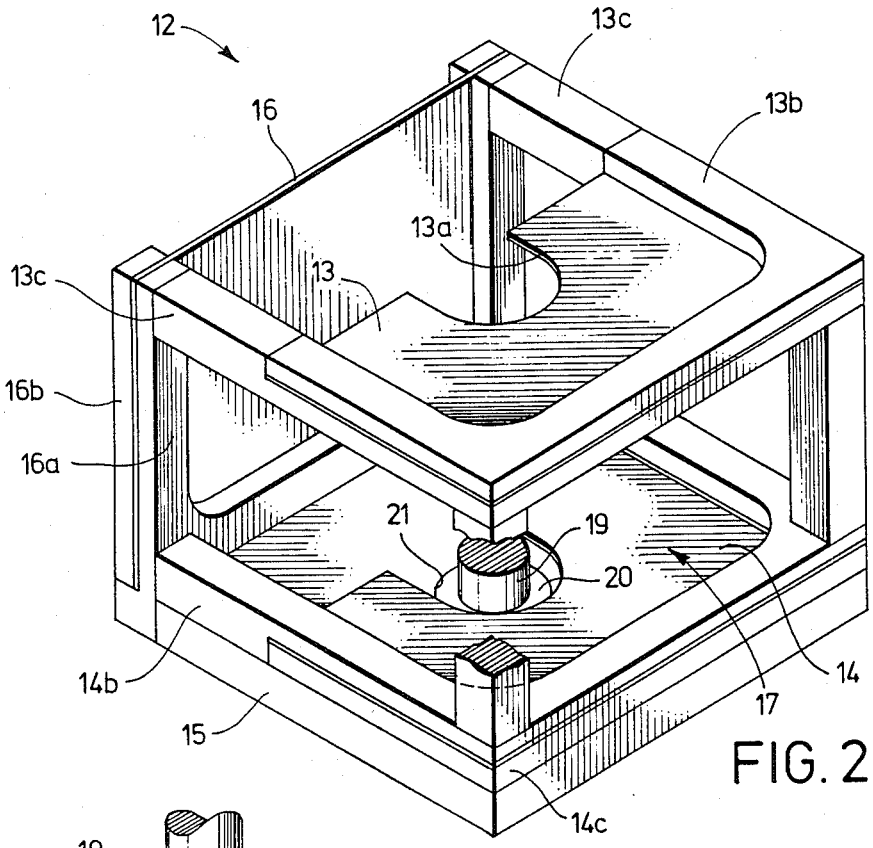
FIG. 2 is an isometric view of the anode structure of the device shown in FIG. 1.

In referring to the Drawings, particularly FIG. 1, the electroplating device of this invention is generally indicated by the letter P. The device includes a plating tank 10, which is filled to a desired level above the anode structure 12 with an electrolyte solution 11 that contains metal ions. The electrolyte can be any of the metal or metal alloy solutions of the type used for plating metal surfaces, such as lead, iron, nickel, copper, zinc, gold, silver, and the like. The device P includes an anode structure generally indicated by numeral 12. Referring particularly to FIG. 2, the anode structure is constructed of several plates that are preferably fabricated of the metal that is to be electro-deposited onto the surface of a metal workpiece.

At the top of the anode structure is a metal plate 13 that has a half round notch **13*a* along the front edge of the plate. This plate is held in place between a top retainer member 13*b* and a bottom retainer member 13*c***.

Directly below plate 13, at the bottom of the anode structure, is a similar metal plate 14 that is held in place between a top retainer member **14*b* and a bottom retainer member 14*c*. In addition, the retainer members are fastened down onto the bottom plate 15. Plate 14 also has a half round notch 14*a* along its front edge, which is directly in line with notch 13*a*** above it.

As shown in FIG. 2, the anode plates 13 and 14 are spaced apart and in parallel relation. The structure 12 includes another plate 16, which is spaced from and perpendicular to plates 13 and 14, and is held in place by an inside retainer member **16*a* and an outside retainer member 16*b*. Each of the anode plates 13 and 14 are partial wall members and the anode plate 16 is a full wall member. These wall members enclose a space that defines an anode chamber, as generally indicated by the vertical arrow 17**.

Referring to FIGS. 1 and 2, the cathode structure of this device is generally indicated by numeral 18. The major part of the structure consists of a solid metal rod 19 that is covered, except at the top end, with a plastic resin coating that is compatible with the electrolyte solution. The coating is not illustrated in the Drawing as a separate component. The bottom end of rod 19 includes a flange 20 that fits down into a bearing seat 21 defined in the bottom plate 15 of the anode structure 12.

Figure 4:
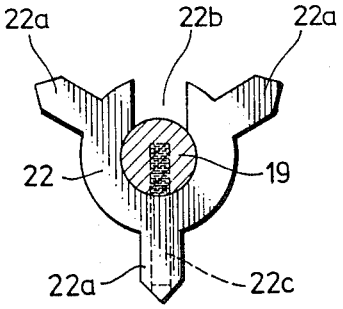
FIG. 4 is a plan view of the workpiece holder.

Another component of the cathode structure is a workpiece holder 22, which has the shape of a partial ring with integral ear members **22*a* that are spaced apart and located around the outside of the ring. On one side of the ring structure of holder 22 is a gap 22*b*, which enables the holder to be attached to rod 19 by a friction fit. The holder 22 also includes a metal pin 22*c*, that extends lengthwise through one of the ear members 22*a*. The inner end of the pin, as shown in FIG. 4, threads into rod 19** and the outer end terminates flush with the outside surface of the ear member in which it is located.

The cathode structure also includes a removable metal workpiece 23, which is to be coated with an electro-platable metal or metal alloy, as described earlier. In the practice of this invention the workpiece 23 whould be one which has axial symmetry, such as the circular workpiece illustrated in the Drawings. When the workpiece 23 is fitted down onto holder 22, the inside surface **23*a* is in contact with the outside end of pin 22*c***.

The device of this invention also includes a means for rotating the rod 19. In the practice of the invention, any conventional means for rotating the rod may be used. An example of such a rotator means, as illustrated in FIG. 1, includes a pulley 24, which is mounted on the top end of rod 19. The pulley is driven by an electric motor 25 through a belt drive 26 that engages the pulley and the motor. The motor is connected to a source of power (not shown) by electrical lead **25*a***.

A means for supplying DC current to the anode structure 12 and the cathode structure 18 is provided by an electrical power unit that includes means for connecting the unit to the anode and cathode. Primary components of the power unit include a rectifier 27, a graphite brush 28, and an anode lead wire 29. The free end of brush 28 makes sliding contact with the top surface of pulley 24 to provide electrical current from rectifier 27 to rod 19 of the cathode structure. Lead wire 29 provides electrical contact between the rectifier in the anode structure 12. The rectifier is connected into an AC power source (not shown) by a lead 30.

In some electroplating jobs it is necessary to heat the electrolyte solution. For example, when the job calls for plating a metal substrate with a nickel coating, the electrolyte solution needs to be at a temperature of about 50° C. to 60° C. for the electro-deposition to be successful. A conventional heater that may be used for such jobs is sometimes referred to as a "hot finger" heater. As illustrated in FIG. 1 the heater consists of a variable power supply unit 31, of the type sold under the name VARIAC, that includes a "hot finger" heater **31*a*. The unit 31 is connected into an AC power source (not shown) by lead 32**.

Some electroplating jobs also require that the electrolyte solution 11 be continuously circulated in the plating tank 10 and directed to a filter to remove impurities. A pump 33 provides means for circulating the electrolyte solution in the tank. As shown in FIG. 1, the electrolyte solution is drawn into he pump 33 through an intake pipe 34 and it passes through a filter unit inside the pump (not shown) to remove metal particles and other contaminating solids. The clean solution is discharged from the pump back into the plating tank 10 through a discharge pipe 35. The pump 33 is connected into an AC power source (not shown) by an electrical lead 36.

To illustrate the practice of this invention, a typical electroplating operation will now be described. In this operation the workpiece 23 is a pump seal with a circular shape and it is fabricated of tungsten carbide. The objective is to coat the pump seal with a layer of nickel to protect it from corrosion damage. At the start of the electroplating operation, the rod 19 is cleaned with a suitable degreasing solvent, such as perchloroethylene, to prevent contaminating the electrolyte solution with any foreign material. The holder 22 is snapped onto the rod near the bottom end and pin **22*c*** is threaded into the rod, as described earlier.

Figure 3:
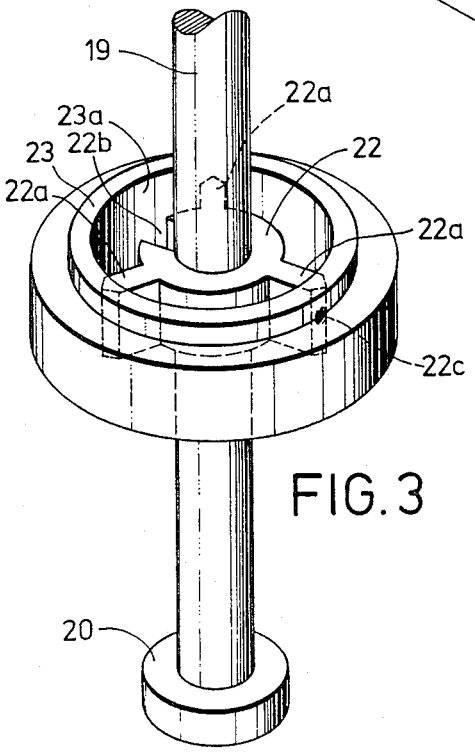
FIG. 3 is a partial view of the cathode structure, in isometric illustration. In this view a metal workpiece is shown as it appears when mounted on a holder for the workpiece.

The pump seal 23 is fitted into the holder 22 so that the outer end of the pin is in contact with the hub **23*a* of the seal, as shown in FIG. 3. The pump seal then becomes the cathode of the electroplating device. The anode structure 12 is placed on the bottom of plating tank 10 and rod 19 fits down into structure 12 so that flange 20 rides in the bearing seat 21. Tank 10 is filled with enough electrolyte solution 11 to cover the anode structure 12 and the open end of the pump intake pipe 34. Any of the well known electrolyte solutions may be used. For example, a typical composition would comprise nickel sulfamate (330 g/l), and boric acid (30 g/l). The motor 25 is started, to rotate pulley 24 and rod 19**.

Pump 33 is started to begin circulating and filtering the electrolyte solution 11. Power supply 31 is activated to bring the electrolyte solution up to a temperature of about 50° C. to 60° C. As pump seal 23 (cathode) revolves inside the anode chamber 17, about half of the outer surface of this piece continuously passes through a region of inftense current flux.

Specifically, the current flux is most intense in that part of chamber 17 that lies directly between the anode plates 13 (top and 14 (bottom). At the same time, the other half of the outer surface of seal 23 is continuously passed through that part of the anode chamber that does not lie between plates 13 and 14. In this part of the chamber the intensity of the current flux is considerably less than that part between the anode plates.

As described earlier, the cathode structure of this invention continuously rotates during the plating operation, and this feature has a beneficial effect in speeding up the rate at which the workpiece 23 (pump seal) is plated. Also, as the workpiece rotates, only part of it, at any one time, passes through the region of the most ihntense current flux. When the workpiece is a circular object, like the pump seal 23, about half of the outer surface of the workpiece periodically passes through a region in the anode chamber 17 where the current flux is of a fairly low intensity. When the workpiece is periodically passing through the low intensity region, the deposition process is periodically slowed down, and this step tends to halt undesirable dendritic growth in the metal layer being deposited on the workpiece.

The invention claimed is:

1. A device for electroplating a workpiece that has axial symmetry, the device comprises:

a plating tank that contains a given amount of an electrolyte solution that includes metal ions;

an anode structure that includes a first anode plate, a second anode plate, and a third anode plate;

the first and second anode plates are spaced apart and in parallel relation, the third anode plate is spaced from the perpendicular to the first and second anode plates;

the space bounded by the first, second, and third anode plates defines an anode chamber in which the first and second anode plates are each partial wall members of the chamber, and the third anode plate is a full wall member;

a cathode structure that includes a metal rod, a workpiece holder that is fastened to the metal rod near one end of the rod by a metal pin, a workpiece having axial symmetry and including an inside surface, the workpiece fits onto the holder such that one end of the metal pin is in contact with the inside surface of the workpiece;

the anode structure is positioned in the plating tank such that the anode chamber is completely submerged in the electrolyte solution;

the metal rod of the cathode structure is positioned in the plating tank such that the workpiece is submerged in the electrolyte solution, the workpiece is positioned inside the anode chamber so that about half of the outside surface of the workpiece lies in that part of the chamber between the first and second anode plates, and the remainder of the outside surface of the workpiece lies in that part of the chamber that is not between the first and second anode plates;

a rotator means associated with the metal rod;

an electrical power unit capable of supplying a DC current to the anode structure and the cathode structure, said unit includes a cathode connector in contact with the metal rod, and an anode connector in contact with the anode structure;

wherein, the rotator means rotates the metal rod to cause the workpiece to revolve inside the anode structure, the power unit directs DC current through the cathode connector into the metal rod and then into the workpiece, and the unit directs DC current through the anode connector into the anode structure, to thereby cause a metal coating to be deposited on the outside surface of the workpiece.

2. The electroplating device of claim 1 in which the metal workpiece has a circular shape.

3. The electroplating device of claim 1 in which the electrical power unit is a rectifier unit, the cathode connector is a brush that makes electrical contact between the rectifier and the metal rod, and the anode connector is an electrical lead that connects the rectifier unit into the anode structure.

4. The device of claim 1 which further includes a heater means in contact with the electrolyte solution, for heating the solution.

5. The device of claim 1 which further includes a pump means that has a filter means, and an inlet and outlet that communicate with the electrolyte solution, for continuously circulating and filtering the electrolyte solution.

6. The device of claim 1 in which the workpiece holder is a ring structure having several spaced-apart ear members around the outside of the ring, and the metal pin that fastens the holder to the metal rod extends through one of the ear members.

7. A method for electroplating a workpiece that has axial symmetry, which comprises the steps of:

fastening a workpiece holder on an elongate metal rod, near one end of the rod, with a metal pin;

fitting the workpiece onto the holder, such that an inside surface of the workpiece is in contact with the metal pin, to provide a cathode structure;

filling a plating tank with a given amount of an electrolyte solution that contains metal ions;

placing an anode structure in the plating tank such that it is submerged in the electrolyte solution, the anode structure has an anode chamber defined by first and second anode plates that are spaced apart and in parallel relation, and a third anode plate that is spaced from and perpendicular to the first and second plates;

lowering the metal rod of the cathode structure into the plating tank to position the workpiece inside the anode chamber so that about half of the outside surface of the workpiece lies in that part of the chamber located between the first and second anode plates, and the remainder of the outer surface of the workpiece lies in that part of the chamber that is not located between the first and second anode plates;

rotating the metal rod to cause the workpiece to revolve inside the anode chamber;

passing a direct current through an electrical power unit into the metal rod and workpiece, and into the anode structure to thereby cause a metal coating to be deposited on the outer surface of the workpiece.

* * * * *